United States Patent [19]

Simons et al.

[11] Patent Number: 4,844,300

[45] Date of Patent: Jul. 4, 1989

[54] MOVABLE TOPPING TABLE FOR A BEER KEG

[76] Inventors: Johan H. Simons, Martin Cudellstraat 3,, 6374 SR Landgraaf; Peter W. M. A. Simons, Gijssenstraat 22, 6391 LC Nieuwenhagen; Martin H. G. M. Simons, Karel Doormanstraat 13, 6374 VC Landgraaf, all of Netherlands

[21] Appl. No.: 180,383

[22] Filed: Apr. 12, 1988

[30] Foreign Application Priority Data

Apr. 16, 1987 [NL] Netherlands ..... 8700916

[51] Int. Cl.[4] ..... B67D 1/16

[52] U.S. Cl. ..... 222/108; 62/389; 220/412; 220/467; 222/131; 222/183; 222/399

[58] Field of Search ..... 222/108, 131, 146.1, 222/146.6, 183, 396, 398, 399, 400.7, 192, 400.8; 62/389; 220/412, 467

[56] References Cited

U.S. PATENT DOCUMENTS

| | | | |
|---|---|---|---|
| 2,090,665 | 8/1937 | Carter | 222/108 |
| 2,228,848 | 1/1941 | Reilly et al. | 222/108 X |
| 2,681,549 | 6/1954 | Maxwell | 222/146.6 X |
| 2,792,692 | 5/1957 | Bryan | 222/146.6 X |
| 3,232,489 | 2/1966 | Buffington | 222/108 |
| 4,164,853 | 8/1979 | McDonough | 62/389 X |
| 4,350,267 | 9/1982 | Nelson et al. | 222/399 X |
| 4,518,104 | 5/1985 | Iannelli et al. | 222/146.6 |
| 4,595,112 | 6/1986 | Dubois | 220/412 X |
| 4,699,282 | 10/1987 | Farrar | 220/467 X |

*Primary Examiner*—Kevin P. Shaver

*Attorney, Agent, or Firm*—Ralph M. Burton

[57] ABSTRACT

Movable beer faucet of the type which is adapted to be used independent of electric power supply, comprising an insulating jacket into which a container filled with beer can be placed, a detachable beer tap with a connection for a carbon dioxide container and a faucet tap. The insulating jacket is open at the bottom, the bottom fitting on a base of insulating material onto which the beer-filled container is to be placed, the top being closed, except for a bung-hole for the beer tap. A separate tapping table is present, provided with a bore for fitting a tapping column and which a collecting cavity over which a perforated tapping plate is placed in the tap surface. Preferably the tapping table is provided with one or two other cavities for a washing basin and/or a rinsing basin.

8 Claims, 4 Drawing Sheets

MOVABLE TOPPING TABLE FOR A BEER KEG

BACKGROUND OF THE INVENTION

The invention relates to a movable beer faucet of the type which is adapted to be used independent of electric power supply, comprising an essentially cylindrical insulating jacket into which a container filled with beer can be placed as well as a detachable beer tap with a connection for a carbon dioxide container and a faucet tap.

The necessity of electric power is an important drawback, particularly because it entails the presence of a connecting cable for electricity. During use, but in particular during transport of the heavy apparatus, there is a great danger of damage and short-circuiting; in combination with beer and water there is certainly a danger of lack of safety. This is avoided with the faucet type with which the invention is concerned.

A movable beer faucet of the type which can function without electric power is known, which is suitable only for a small barrel of beer having a capacity of 10 liters. The insulating jacket is closed at the bottom and open at the top so that the small barrel with the beer tap to be mounted thereon can be easily positioned. In order to prevent a rapid increase in temperature of the contents of the small barrel a cooling ring is made available. This ring is designed as a cooling element which is to be frozen in a deep harden freeze compartment.

OBJECT OF THE INVENTION

The invention aims to provide a movable beer faucet suitable for use with the relatively large beer barrels, standardized to 30 and 50 liters. Another object is to provide for still further facilities for conveniently serving an excellently presented glass of beer while the whole nevertheless remains movable.

SUMMARY OF THE INVENTION

The beer faucet according to the invention has the substantially cylindrical insulating jacket open at the bottom, the bottom fitting on a base of insulating material onto which the beer-filled container is to be placed, the top of the jacket being closed, except for a bunghole for the beer tap. A tapping table is present, provided with a bore for fitting a tapping column and with a collecting cavity over which a perforated tapping plate is placed in the tap surface.

In this manner, the heavy beer barrel merely has to be lifted over the relatively small height of the base. The insulating jacket which is closed at the top can subsequently be pushed over the barrel from above. All this is easily manageable in a manner such that centering takes place automatically. Due to the fact that the jacket serves as insulating jacket and insulating materials usually very lightweight, the jacket is easy to handle. The interior space of the beer barrel which is generally delivered cold by the supplier can then simply be kept fully closed by placing a detachable plug on the bunghole. The low temperature can thus be maintained for a considerable time.

The tapping table can be easily positioned on the top, which is always closed, of the insulating jacket, while the tap surface can then be positioned at such a distance from the ground that the height of the table is convenient to work with.

This is preferably designed so that the tapping table is provided with another cavity for a washing basin, the bore for the pump being fitted centrally between this washing basin and the collecting cavity with the tapping plate. Furthermore, the washing basin preferably contains a partition so that a washing basin and a rinsing basin are present.

In this manner, a movable faucet is obtained with which a glass of beer can be served which meets the requirements set in all respects.

In further detail two favourable embodiments are envisaged. In the first one of these the collecting cavity and the washing basin cavity (cavities) are moulded cavities integral with the tapping table, there being provided a water supply pipe as well as for each of the collecting cavity and the washing basin cavities drainage pipes which rest against the outer sides of the moulded washing basin(s). This is the more perfect embodiment for use when facilities for water supply and drainage are close by.

In the other embodiment, for use when the beer faucet is to be used at some place without water supply and drainage, removable trays are provided, adapted to be used as collecting cavity and washing basin(s).

The base on which the beer barrel is placed may consist of a simple disc or plate provided with an upright edge. This is preferably designed so that the outer circumference of the base becomes conically smaller towards the top and interacts with a corresponding conical surface of a widening of the interior cavity within the jacket of the insulating barrel.

The invention will be explained hereinafter with reference to a drawing of an exemplary embodiment.

SHORT DESCRIPTION OF THE FIGURES

DETAILED DESCRIPTION OF THE PREFERRED EMBODIMENT

Figure 1:
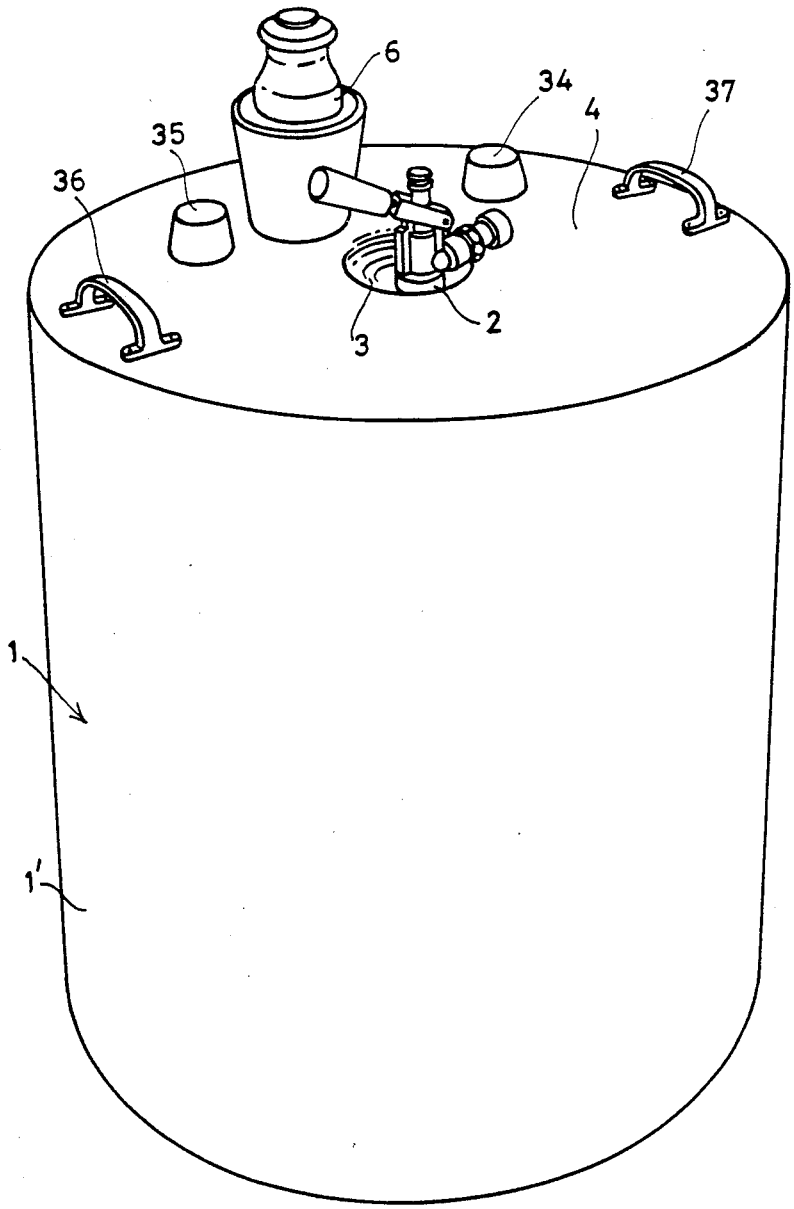
FIG. 1 shows in perspective the insulating barrel.

FIG. 1 shows the insulating barrel 1 drawn in the state in which a barrel of beer is placed in it, while the beer tap 2 projects through an opening 3 in the otherwise closed upper surface 4.

Figure 3:
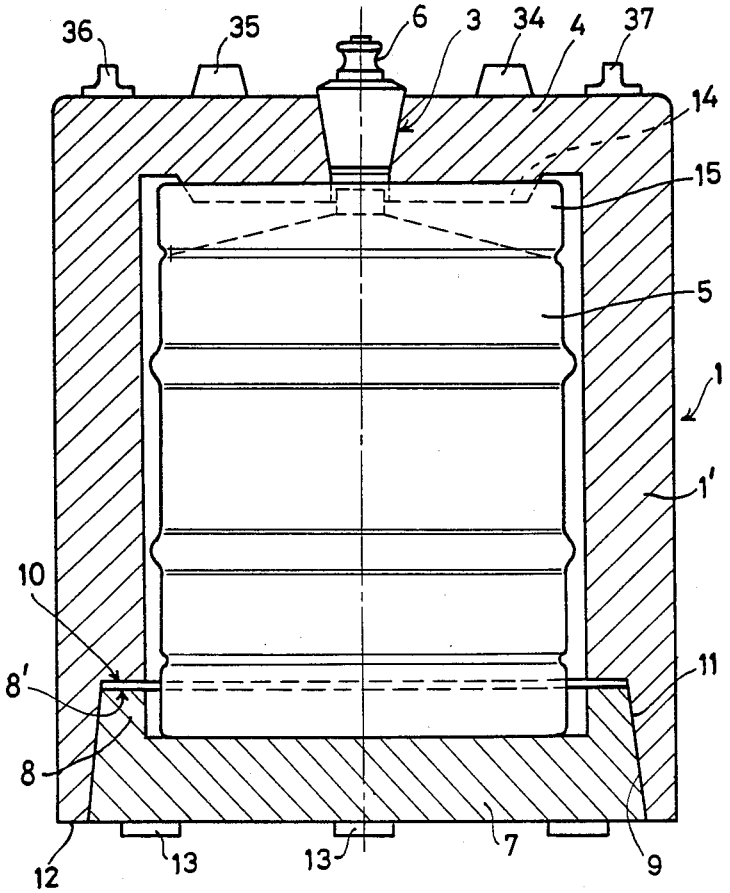
FIG. 3 is an axial section through the insulating barrel with a barrel of beer contained therein.

The jacket 1' of the insulating barrel is essentially cylindrical both inside and outside as appears from the axial section of FIG. 3. This last-mentioned section has been drawn in the state in which a barrel of beer 5 is present in the interior but has not yet been tapped. The opening 3 is then closed by a detachable conical plug 6.

The barrel 5 stands on a base 7 which is essentially disc-shaped, has an upright edge 8 and a peripheral wall 9 which extends conically upwards. The lower end of the cylindrical wall 1' of the insulating barrel has a shape matched to the base, i.e. a widening of the cylindrical interior space with a section 10 running horizontally outwards, merging in a conical wall section 11. In order to ensure a satisfactory seal even after long-term use the dimensioning can be realized such that the starting point is formed by a small intermediate space between the horizontal surface 10 and the upper surface 8' of the edge 8 of the base so that conical surfaces 9 and 10 can be completely pushed over each other until they are closed. The lowermost edge 12 of the jacket then always remains removed from the floor because a few smaller carrier plates, for example 13, are fitted under the base.

The interior dimension of the upright edge 8 of the base and that of the cylindrical wall 1' are chosen such that they can receive a barrel 5 with some play, the barrel having a capacity of 50 liters, with standardized dimensions. An insert can be supplied for placing a barrel having a capacity of 30 litres (not shown in the drawing). The internal height is also suitably chosen for receiving a 50-liter barrel, an annular cavity 4' then being recessed in the upper wall 4 for receiving the edge 5' of the barrel while the space above the barrel within the edge 5' is then filled as much as possible by the insulating material of the upper surface 4 of the insulating barrel in order to obtain a maximum insulation.

Both the insulating barrel 2 and the base 3, and preferably also the plug 6, are made of plastic foam, lined with a layer of rigid plastic.

Figure 2:
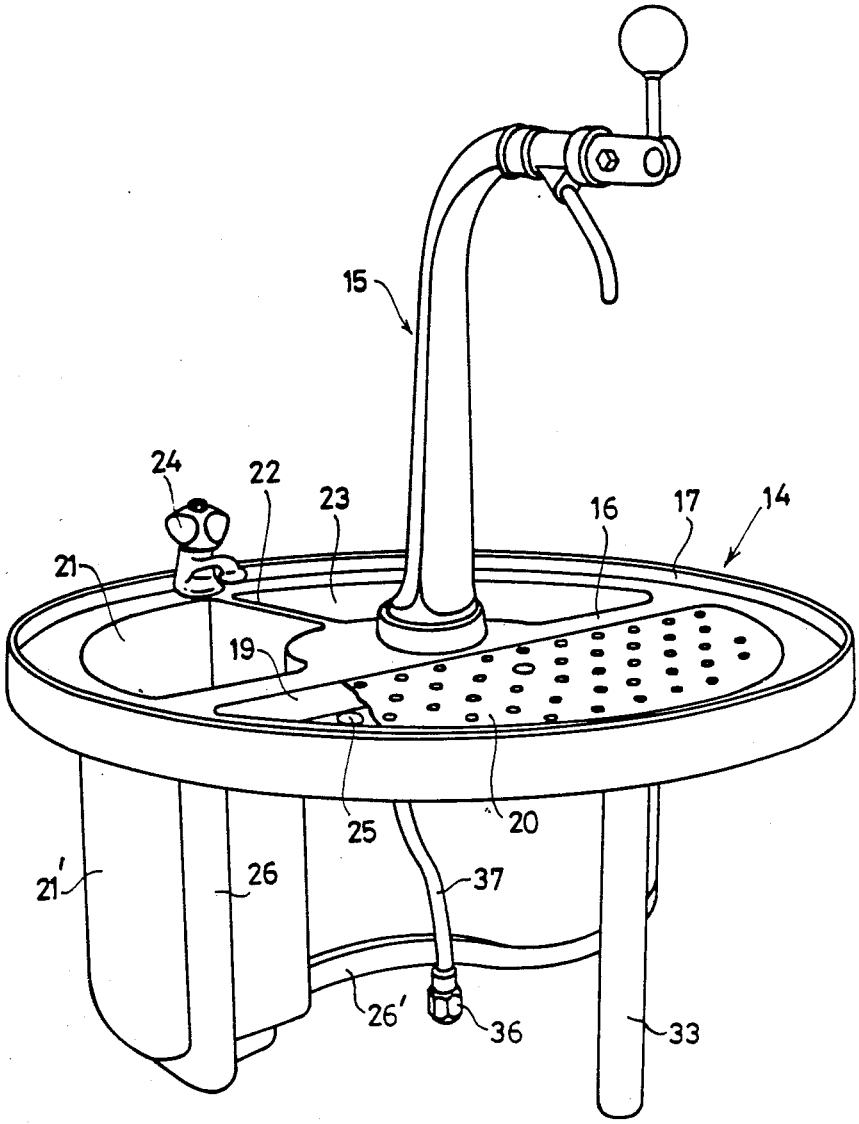
FIG. 2 shows in perspective the tapping table to be placed on the insulating barrel.

The upper part of the tapping table is shown in its entirety in FIG. 2, indicated by 14, while FIG. 14 shows the bottom view, although in the state in which the tapping column 15 has not yet been fitted.

In this embodiment the tapping table 14 is round. A raised peripheral edge 17 projects above the tap surface 16. A bore 18 (see FIG. 4) is provided in the middle for passing through and fixing the tapping column 15. On one side of a diametrical line through the center point, a depression 19 is provided in the tap surface 16, molded integrally and forming a collecting cavity for beer overflowing during tapping. This collecting cavity 19 is thus virtually semi-circular and is covered by a plate 20 which is perforated and consists of chrome-plated steel as usual for tapping plates.

On the other side of the said imaginary diametrical line an integrally formed circular sector-shaped depression 21 is present having a depth relative to the tap surface 16 such that it forms a washing basin is present It is conceivable that a single washing basin is sufficient, but in the embodiment represented a partition 22 is present so that a rinsing basin 23 is obtained in addition to the washing basin 21. A tap 24 is fitted on the edge for supplying water to the washing basin. The height of the washing basin 21 is evident from FIG. 2 in which its outer side is indicated by 21'.

Figure 4:
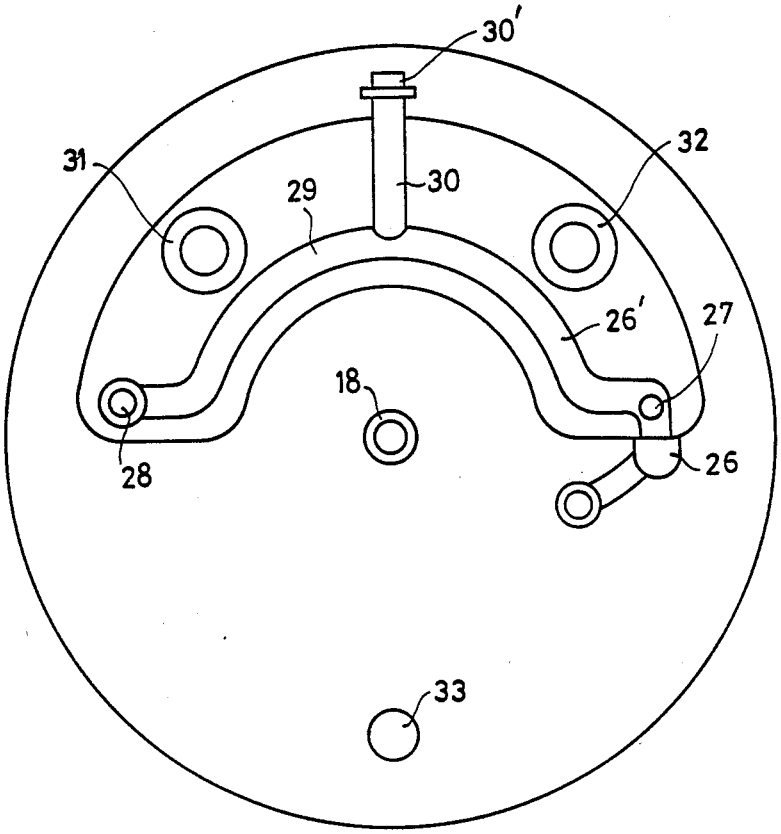
FIG. 4 is a bottom view of the tapping table.

The bottom view of the tapping table in FIG. 4 shows the manner in which various pipes are fitted. The drainage opening 25 in the beer collecting cavity 19, also visible in FIG. 2, has at its lower side a drainage pipe 26 which first runs, as also shown in FIG. 2, along the outer wall 21' of the washing basin downwards and subsequently, as indicated in FIG. 4 by 26', extends around the bottom side of the washing basins, after, however, being combined with a drain 27 of the washing basin 21. The drainage of water from the washing basins may take place in a known manner via an overflow pipe not shown in FIG. 2. The other washing basin 23 has a similar drainage opening 28 to which a drainage pipe 29 connects. The two drainage pipes 29 and 26' are subsequently combined to form a common drain 30 which extends radially along the bottom side of the washing basins, approximately at the height of the partition 22, towards the outside. A detachable hose can subsequently be placed on the projecting end 30' thereof, this hose leading to a sink or valve.

In the bottom view of FIG. 4, the projecting end 30' of the drainage pipe obstructs the view of a connecting end of the water supply pipe to the tap 24 which water supply connection in this embodiment is present in the same radial plane, but higher i.e. directly beneath the tap surface 16, and thus directly below the peripheral edge 17 at the place of the tap 24.

It is also possible to provide the collecting cavity 19 and the washing and rinsing basins 21, 23 in form of removable trays or bins. They may either be placed in and supported by the integrally formed cavities as shown in the drawings, or these cavities may be omitted and the loose trays or bins may have edges but in such way that they can be supported by the circumferential edges of apertures in the tapping table.

It can be seen in FIG. 4 that a set of support rings 31 and 32 is moulded to the underneath of the bottom surface of the washing basins 21 and 23, respectively, these support rings being conical inside. The end of a leg 33 which is also visible in FIG. 2 is furthermore to be seen. When the faucet 14 is placed on the insulating barrel the supports 31, 32 come to rest on the externally conical support blocks 34 and 35 which are shown in FIG. 1 and are firmly connected to the upper surface 4 of the insulating barrel. By this means the tapping table 14 is sufficiently centered and the leg 33 can then simply come to rest on top of the upper surface 4 of the insulating barrel. It is otherwise conceivable to supply suitably formed connecting pieces for the supports 31, 32, 34, 35 and the leg 33 so that the user can, if desired, place the tapping table 14 at a greater height relative to the insulating barrel which will normally stand on the ground by its carrier plates 13.

The insulating barrel 1 is furthermore provided with a few handles 36, 37, which in this embodiment are fitted to the upper side.

During use the procedure is as follows.

With the jacket 1', 4 removed, a barrel of beer 5, which is in a cold state, is placed on the base 7. The cylindrical jacket 1' is thereafter placed on top of this, centering taking place automatically. The plug 6 remains on the hole 3 until tapping is required. After removal of the plug 6 the barrel can be tapped by screwing in the beer tap 2. The tapping table 14 into which the tapping column 15 has been fitted beforehand is then positioned. A connection is made between the tapping column 15 and the beer tap 2 using the connecting joint 38 at the lower end of a connecting hose 39; after provision of the connections between the tap 24 and the water pipe and fitting a drainage hose to the drainage pipe 30, 30' the beer faucet is ready for use.

Inside the space below the tapping table, between the leg 33 and the beer pipe 39, a large space is available for placing a container with liquid carbon dioxide which can be connected in a known manner to the beer tap. By this means, carbon dioxide containers of considerable size can be used.

What is claimed is

1. A movable beer faucet of the type which is adapted to be used independent of electric power supply comprising, in combination:

an essentially cylindrical insulating jacket open at the bottom and closed at the top;

a low profile, solid, disk-like base of insulating material on to which a beer keg can be placed and supported;

said base and the open bottom of the jacket having interfitting wall portions whereby the jacket can be introduced over a beer keg supported on the base with the wall portions interfitting for mounting the jacket on the base and insulating the connection therebetween;

a bunghole in the closed top of the jacket for introducing a detachable beer tap therethrough;

a tapping table removably mountable on and supported by the closed top of the jacket above the bunghole and having an upstanding beer faucet thereon connectable to said beer tap extending through the bunghole; and said table having a beer collecting cavity and a washing basin adjacent the faucet.

2. The invention defined by claim 1 wherein the beer collecting cavity and the washing basin are molded integral with the tapping table.

3. The invention defined by claim 2 characterized by a water supply pipe for the washing basin and drainage pipes for the collecting cavity and washing basin.

4. The invention defined by claim 1 wherein at least one of said beer-collecting cavity and washing basin comprise removable trays supported on the tapping table.

5. The invention defined by claim 1 wherein the tapping table is provided with supports adapted to cooperate with elevations on the top of the insulating jacket for centering the table on the jacket.

6. The invention defined by claim 1 wherein the disk-like base is provided with an upright peripheral edge within which a beer keg may be fitted.

7. The invention defined by claim 1 wherein said interfitting wall portions comprise an upright peripheral edge of the disk-like base into which a beer keg may be fitted and the outer circumference of the base becomes conically smaller towards the top and fits within a corresponding internal conical surface of the jacket which widens toward the bottom.

8. The invention defined by claim 1 wherein the inside of the top of the insulating jacket is provided with an annular recess for receiving an edge of a beer keg.

* * * * *

UNITED STATES PATENT AND TRADEMARK OFFICE

CERTIFICATE OF CORRECTION

PATENT NO. : 4,844,300

DATED : July 4, 1989

INVENTOR(S) : JOHAN H. SIMONS, PETER W.M.A. SIMONS, MARTIN H.G.M. SIMONS

It is certified that error appears in the above-identified patent and that said Letters Patent is hereby corrected as shown below:

In the title of the patent, please delete the word "Topping" and insert in its place the word ---Tapping---.

--

Signed and Sealed this

Twenty-seventh Day of March, 1990

*Attest:*

JEFFREY M. SAMUELS

*Attesting Officer*

*Acting Commissioner of Patents and Trademarks*